US011123602B2

(12) United States Patent
Kueker

(10) Patent No.: US 11,123,602 B2
(45) Date of Patent: Sep. 21, 2021

(54) MECHANICAL BRAKING SYSTEM FOR EXERCISE MACHINES

(71) Applicant: True Fitness Technology, Inc., O'Fallon, MO (US)

(72) Inventor: Jared Kueker, St. Charles, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 196 days.

(21) Appl. No.: 15/861,437

(22) Filed: Jan. 3, 2018

(65) Prior Publication Data

US 2018/0185699 A1 Jul. 5, 2018

Related U.S. Application Data

(60) Provisional application No. 62/441,789, filed on Jan. 3, 2017.

(51) Int. Cl.
*A63B 22/02* (2006.01)
*A63B 21/005* (2006.01)
(Continued)

(52) U.S. Cl.
CPC ..... *A63B 22/0257* (2013.01); *A63B 21/0056* (2013.01); *A63B 22/0023* (2013.01); *A63B 22/025* (2015.10); *A63B 22/0235* (2013.01); *A63B 22/0264* (2015.10); *A63B 24/0087* (2013.01); *A63B 71/0054* (2013.01);
(Continued)

(58) Field of Classification Search
CPC ..... A63B 22/0257; A63B 71/0054; A63B 22/0235; A63B 22/0023; A63B 22/025; A63B 22/0264; A63B 21/0056; A63B 24/0087; A63B 21/0085; A63B 21/008;
(Continued)

(56) References Cited

U.S. PATENT DOCUMENTS 3,602,502 A * 8/1971 Hampl ..... A63B 22/025 482/7
4,231,452 A * 11/1980 Kraft ..... B66B 29/00 188/171
(Continued)

FOREIGN PATENT DOCUMENTS

CN 2319090 Y 5/1999
KR 200360465 * 8/2004
(Continued)

OTHER PUBLICATIONS

International Search Report, International Patent Application No. PCT/US2018/012229, dated Apr. 30, 2018 (10 pages).
(Continued)

*Primary Examiner* — Sundhara M Ganesan
*Assistant Examiner* — Shila Jalalzadeh Abyaneh
(74) *Attorney, Agent, or Firm* — Lewis Rice LLC

(57) ABSTRACT

A mechanical braking system for a high-incline treadmill utilizing a mechanical brake which may be used on its own or in combination with a traditional motor brake. The mechanical brake is generally mountable on a treadmill between or around the belt motor and the flywheel. Upon engagement of the brake, typically the brake engages the flywheel, the motor, or the axle in a way that effectively locks the axle, and thus the belt, in a fixed position.

1 Claim, 3 Drawing Sheets

(51) Int. Cl.

| | |
|---|---|
| ***A63B 24/00*** | (2006.01) |
| ***A63B 22/00*** | (2006.01) |
| ***A63B 21/22*** | (2006.01) |
| ***A63B 21/015*** | (2006.01) |
| ***A63B 71/00*** | (2006.01) |
| *A63B 21/008* | (2006.01) |

(52) U.S. Cl.
CPC ..... *A63B 21/008* (2013.01); *A63B 21/0085* (2013.01); *A63B 21/015* (2013.01); *A63B 21/225* (2013.01); *A63B 2071/0081* (2013.01); *A63B 2220/18* (2013.01); *A63B 2220/30* (2013.01)

(58) Field of Classification Search
CPC ..... A63B 2071/0081; A63B 21/015; A63B 21/225; A63B 2220/30; A63B 2220/18
See application file for complete search history.

(56) References Cited

U.S. PATENT DOCUMENTS

| | | | | |
|---|---|---|---|---|
| 4,713,567 | A | 12/1987 | Fey et al. | |
| 5,267,925 | A * | 12/1993 | Boyd | A63B 21/0056 188/77 R |
| 5,318,487 | A | 6/1994 | Golen et al. | |
| 5,361,022 | A | 11/1994 | Brown | |
| 5,374,227 | A | 12/1994 | Nebb | |
| 5,643,142 | A | 7/1997 | Salerno et al. | |
| 5,685,804 | A | 11/1997 | Whan-Tong et al. | |
| 5,747,955 | A | 5/1998 | Rotunda et al. | |
| 5,856,736 | A | 1/1999 | Rotunda et al. | |
| 5,944,635 | A | 8/1999 | Butler, Jr. | |
| 6,761,667 | B1 * | 7/2004 | Cutler | A63B 22/0023 482/51 |
| 6,908,416 | B2 | 6/2005 | Mercado et al. | |
| 7,517,303 | B2 | 4/2009 | Crawford et al. | |
| 7,559,879 | B2 | 7/2009 | Anderson et al. | |
| 7,621,850 | B2 | 11/2009 | Piaget et al. | |
| 7,811,209 | B2 | 10/2010 | Crawford et al. | |
| 7,862,483 | B2 | 1/2011 | Hendrickson et al. | |
| 8,403,816 | B2 | 3/2013 | Park | |
| 9,216,317 | B2 | 12/2015 | Golen, Jr. et al. | |
| 9,623,281 | B2 | 4/2017 | Hendrickson et al. | |
| 2002/0016235 | A1 * | 2/2002 | Ashby | A63B 21/005 482/8 |
| 2002/0100646 | A1 * | 8/2002 | Maurice | H02K 7/1023 188/161 |
| 2006/0169550 | A1 * | 8/2006 | Albrecht | F16D 55/02 188/161 |
| 2007/0123396 | A1 | 5/2007 | Ellis | |
| 2009/0137367 | A1 * | 5/2009 | Hendrickson | A63B 24/00 482/54 |
| 2012/0264572 | A1 | 10/2012 | Fenster et al. | |
| 2014/0187387 | A1 | 7/2014 | Fenster et al. | |
| 2014/0221160 | A1 | 8/2014 | Hardy et al. | |
| 2016/0175643 | A1 * | 6/2016 | Kueker | A63B 22/0023 482/5 |
| 2016/0354638 | A1 | 12/2016 | Carr | |
| 2017/0001075 | A1 * | 1/2017 | Butler, Jr. | A63B 24/0087 |
| 2017/0246500 | A1 | 8/2017 | Gatti et al. | |
| 2017/0348559 | A1 | 12/2017 | Andrade | |
| 2018/0104533 | A1 * | 4/2018 | Powell | H02K 7/1008 |

FOREIGN PATENT DOCUMENTS

| | | | |
|---|---|---|---|
| KR | 2003604650000 | Y1 | 8/2004 |
| KR | 1020160124343 | A | 10/2016 |

OTHER PUBLICATIONS

Extended European Search Report issued for EP18736732.1, dated Jun. 25, 2020, 8 pages.

* cited by examiner

MECHANICAL BRAKING SYSTEM FOR EXERCISE MACHINES

CROSS-REFERENCE TO RELATED APPLICATIONS

This application claims benefit of U.S. Provisional Patent Application No. 62/441,789, filed Jan. 3, 2017, the entire disclosure of which is incorporated herein in its entirety by reference.

BACKGROUND OF THE INVENTION

Field of the Invention

This disclosure is related to the field of exercise equipment, specifically to a mechanical braking system for use with a high-incline treadmill.

Description of the Related Art

The benefits of regular aerobic exercise on individuals of any age are well documented in fitness science. Aerobic exercise can dramatically improve cardiac stamina and function, as well as lead to weight loss, increased metabolism, and other benefits. At the same time, aerobic exercise has often been linked to damaging effects, particularly to joints or similar structures, where the impact from many aerobic exercise activities can cause injury. Therefore, those involved in the exercise industry are continuously seeking ways to provide users with exercises that have all the benefits of aerobic exercise, without the damaging side effects.

Many exercises, however, have built-in limitations for strenuousness. Some studies have indicated that any person's natural walking speed may be preferentially selected to minimize work for desired distance and time. Thus, natural walking as an exercise can be problematic because humans may naturally walk in a very efficient fashion, which can minimize its exercise potential as the purpose for exercise is generally to require the body to do "extra" work.

To impose additional strenuousness on an exercise machine, inclines are commonly used. Inclines force the user to walk, run, or climb consistently "uphill." That is, the user is having to fight gravity as part of the exercise movement. High incline exercise machines can provide inclines as part of an exercise which can be performed at any incline (such as walking or running), while other high-incline exercise machines can provide for specific climbing activities such as stair climbing, ladder climbing, or rock climbing which generally can only be performed vertically. Regardless of the type of exercise, inclusion of a vertical component of an exercise will generally rapidly increase its strenuousness over comparable motions and can be particularly valuable on exercise machines where variables such as terrain variation and wind resistance aren't factors. Walking or running at even a relatively slight angle above neutral has been shown to dramatically increase the strenuousness of the walking or running, and stair climbing can be an extremely effective exercise when carried out for even relatively short time periods.

High incline machines can have usability issues, however. This is particularly true for those that produce an inclined surface using a continuous smooth belt, such as high-incline treadmills. The machines can feel unstable at high inclines as the user is working against a moving system, while also working against the pull of gravity. Further, because of the incline, gravity's pull is often not straight down, but partially backward, which can feel awkward to the user. Further, as the incline increases, the user's feet may make less contact with the belt, as the foot position moves from the sole to primarily only the toes. A user is, thus, concerned about falling backward off the machine due to belt motion, and falling off the machine and onto the floor due to slipping on the belt or falling backwards. Further, at higher speeds, the movement of the belt can be substantial and the user needs to keep up. This often results in users leaning back or forward in poor posture positions to achieve a more comfortable balance on the device.

The fear of falling is not unjustified. Walking and running are motions that can easily result in falls, and carrying out such motions on an exercise machine, where space is limited and the motion is slightly unnatural, can result in additional falls. In fall situations, most modern exercise machines use some form of pull-key safety system to stop the machine, reducing additional injury after the fall from being struck by moving parts, or being "thrown" into other objects from the continuing movement of the machine after the user has fallen. Safety key systems can utilize a number of different specific mechanisms to trigger, but all generally operate in accordance with the same principle: when the safety key is pulled, the electrical connection from the electrical source to the motor is broken via some form of circuit breaker mechanism. Thus, there is immediately no power provided to the motor, and the motor will quickly stop due to internal friction and induced field reversal.

Braking and stopping systems in exercise machines may also provide for belt movement smoothness (e.g., counteract the weight of the user as the machine inclines, and therefore maintain constant belt speed during a change in incline) and provide a fixed amount of resistance. However, braking mechanisms in exercise machines traditionally rely on internal motor and belt friction. Generally, the halting of the belt results from a user's weight on the belt pushing the belt into the tread deck on which the belt is situated. Once the motor is stopped, the friction between the belt and the tread deck becomes a much more substantial force acting on the belt. Further, a stopped motor has internal friction from the components (generally electromagnets) which turn the axle when the motor is powered having to be forced through unpowered motion. Thus, stopping the motor results in substantial friction against the belt which, given the force of the user's weight on the belt, is usually sufficient to halt the movement of the belt.

While this type of braking is sufficient for stopping the belt in most circumstances, (including emergencies) when the belt is at a relatively low angle, these systems do not always work with higher-incline exercises. At a higher-incline angle, gravity does not pull all, or a vast majority, of the user's mass into the belt and tread deck. Instead, it pulls the user's mass at the inverse of the angle of incline, which is backwards (to the user) in most cases. Thus, a significant portion of the user's mass is being pulled in the direction of belt rotation. This decreases the amount of force imparted by friction to stop the belt, and also increases the amount of force imparted by a user's mass in the rotational vector of the belt. This two prong difference in the forces imparted by the presence of the user's mass on a high-incline system is much less than on a low-incline, and the net change may continue to move the belt, instead of slowing.

A second issue in many traditional friction systems is that while a traditional brake can often stop the movement of the belt, the belt will only be held while the brake is engaged. In a motor brake, this may stop and hold the belt for only a relatively short period of time (e.g. for a second or two) as the motor resists movement due to an induced reversal of the internal magnetic fields. However, once the belt stops, the force to move it again may actually be less and the system may "let up" on the brake once the power disconnect has completed. Systems which rely on this induced electric field and internal motor friction for emergency braking can, thus, go into a free motion state a few seconds after power is disconnected. For a high-incline exercise machine, particularly a treadmill, this can make an emergency stop while the device is at a high-incline particularly problematic. Specifically, the freewheeling presents a second point of danger to the user from belt motion resuming after it has stopped and generally once the user has fallen onto the belt.

This latter concern is best illustrated by considering an emergency stop where the user is in distress. In prior systems, when the safety key is pulled, the motor immediately stops and the belt is generally held in its position for a second or two as the engine resists the motion of the belt. While this can cause a user to pitch forward, as the emergency stop generally only occurs when a user has moved sufficiently far away from the standard operating position of the machine to indicate a likely problem, it generally isn't an issue, and the greater concern is a user who has fallen falling onto the moving belt. Thus, by having the belt come to a complete and prompt stop the user is inhibited from becoming injured by moving components.

In traditional systems, once the belt has stopped, the brake is commonly released shortly thereafter, because the force imparted by the stopped motor to resist movement of the belt is decreased as the effective reversal of electric fields in the motor dissipates after the electricity is shut off. Without any power, the motor can freewheel, resisted only by its internal friction, after the belt has stopped. If a user actually has fallen on the treadmill and is lying on a substantially horizontal belt or has otherwise left the machine, this does not present much danger as the belt will generally have little to no force on it to move and therefore the movement will not overcome inherent friction. However, for a treadmill at a substantial angle or incline, this can present a risk of injury as the user's mass effectively serves to freewheel the belt and push them off the back of the treadmill.

A user who has fallen into the belt generally is not only lying against or on the belt, but a substantial amount of the user's body mass is pulled by gravity along the path of motion of the belt. Thus, when the brake releases (or more accurately the resistance in the motor decreases) and the belt can freewheel, the force of the user's weight on the belt can actually move the belt in a completely separate motion and this can be relatively quickly backwards. Thus, braking systems which do not remain engaged until the system has been "safed" (e.g. the user is no longer in contact with the treadmill at all) can be dangerous for emergency braking scenarios at high-inclines.

Freewheeling occurs because of the design of most treadmill motors and brakes. By far the most common type of motor used in treadmills is an induction motor. As should be apparent, the rotation of the rotor in an induction motor (whether single phase or three phase) is dependent on an alternating current being supplied to the stator and a rotating magnetic field being created. As soon as the current is removed, the rotating magnetic field in the stator dissipates. There is, thus, no induced electrical current in the rotor. However, as there is some instantaneous current in the rotor due to its rotational inertia at the instant of power cut-off, the rotor will attempt to generate electricity in the stator, but this will be directly reversed to the previously provided flow. In effect, at this instant, the slip goes from positive to negative in a very short period of time. The rotor thus stops suddenly as the electricity in the stator creates very high resistance to continued movement of the rotor and causes the mechanical motion to cease.

However, after the rotor has stopped and the electrical currents in the system have dissipated, the motor effectively becomes a generator. As there is no electrical current in the stator, there remains only mechanical resistance preventing the rotor from rotating and generating an induced electrical current in the stator. Thus, in an emergency stop scenario where power is cut to the motor, the motor will rapidly come to a halt due to the braking applied from the opposing fields, but shortly thereafter, the motor will become a generator and the belt may be moved with the motor freewheeling since there is no electrical flow and only mechanical friction (which is often purposefully relatively small) to resist movement of the rotor.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a method for braking moving components of an exercise machine, the method comprising: providing a high-incline treadmill including: a running deck having a belt roller disposed at one end thereof and a continuous belt disposed around the running deck and belt roller; an electric belt motor operatively coupled to the belt roller via a motor axle; a flywheel disposed on the motor axle; a mechanical brake; supplying the electric belt motor with electricity; operating the electric belt motor with the electricity, the operating turning the belt roller to move the continuous belt around the running deck; and removing the electricity supply from the electric belt motor; and braking the moving continuous belt with the mechanical brake.

In an embodiment of the method, the braking step comprises the mechanical brake is operatively attached to the electric belt motor and the braking step comprises the mechanical brake braking the electric belt motor.

In another embodiment of the method, the braking step comprises the mechanical brake is operatively attached to the flywheel and the braking step comprises the mechanical brake braking the flywheel.

In another embodiment of the method, the braking step comprises the mechanical brake is operatively attached to the motor axle and the braking step comprises the mechanical brake braking the motor axle.

In another embodiment of the method, the mechanical brake is disposed on the motor axle between the electric belt motor and the flywheel.

In another embodiment of the method, the mechanical brake is an electrically-released spring-set brake.

In another embodiment of the method, the mechanical brake is pneumatic brake.

In another embodiment of the method, the mechanical brake is a hydraulic-set brake.

In another embodiment of the method, the mechanical brake is an electrically-released spring-set brake.

Also described herein, among other things, is a method for breaking moving components for an exercise machine, the method comprising: providing a treadmill including: a running deck having a belt roller disposed at one end thereof and a continuous belt disposed around the running deck and belt roller; an electric belt motor operatively coupled to the belt roller via a motor axle; a flywheel disposed on the motor axle; a mechanical brake; a tilt sensor; supplying the electric belt motor with electricity; operating the electric belt motor with the electricity, the operating turning the belt roller to move the continuous belt around the running deck; and removing the electricity supply from the electric belt motor; sensing, with the tilt sensor, an amount of incline of the running deck; and braking the moving continuous belt with the mechanical brake only if the sensed amount of incline is above a predefined threshold.

In an embodiment of the method, the electric belt motor comprises a stator and rotor; the mechanical brake is an electromagnetic brake comprising: a brake mount sized and shaped to mount to the electric motor, the brake mount mounting the mechanical brake to the stator; an armature movable between a braking position and a non-braking position and biased to the braking position by a biasing means; a brake pad disposed between the brake mount and the armature; and a brake coil; supplying the mechanical brake with electricity to energize the brake coil, the energized brake coil moving the armature from the braking position to the non-braking position; removing the electricity supply from the mechanical brake; and in braking step, the removed electricity de-energizing the brake coil such that the biasing means moves the armature to the braking position.

In a further embodiment of the method, supplying the electric belt motor with electricity and the mechanical brake with electricity occur at about the same time.

In another further embodiment of the method, the removing the electricity supply from the electric belt motor and the removing the electricity supply from the mechanical brake occur at about the same time.

In another further embodiment of the method, removing the electricity supply from the electric belt motor and the removing the electricity supply from the mechanical brake are caused by a power failure.

In another further embodiment of the method, removing the electricity supply from the electric belt motor and the removing the electricity supply from the mechanical brake are caused by removing of a safety key from the treadmill.

In another further embodiment of the method, removing the electricity supply from the electric belt motor and the removing the electricity supply from the mechanical brake are caused by completing or pausing a pre-programmed workout routine.

In another further embodiment of the method, the biasing means comprises one or more springs.

In a further embodiment of the method, the predefined threshold is selected from the group consisting of: 15%, 18%, 20%, 25%, 30%, and 35%.

In another embodiment of the method, the treadmill further comprises a belt speed sensor; sensing, with the belt speed, the speed of the moving continuous belt; in the braking step, braking the moving continuous belt with the mechanical brake only if the sensed belt speed is above a predefined threshold.

DESCRIPTION OF THE PREFERRED EMBODIMENT(S)

Figure 1A:
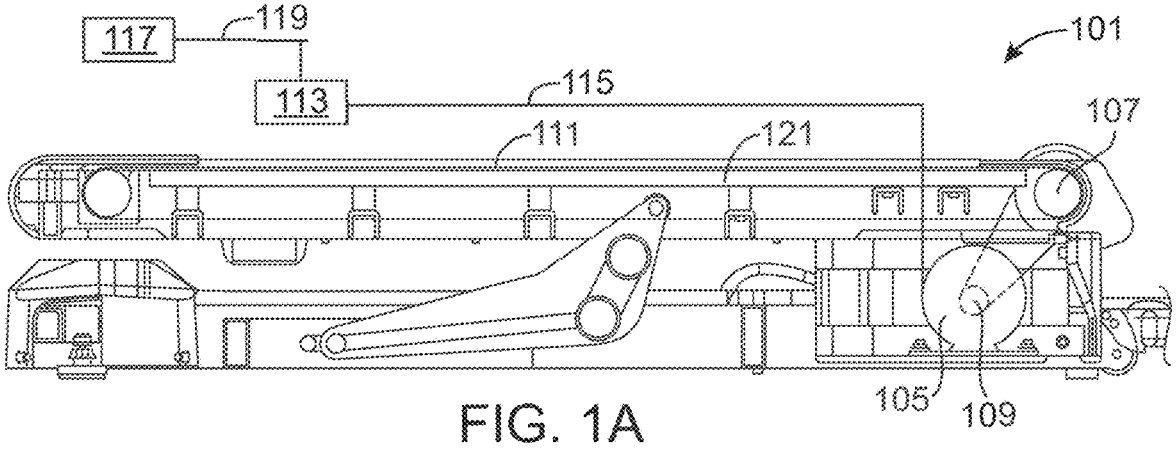
FIGS. 1A, 1B, and 1C provide a typical embodiment of a treadmill exercise machine that may utilize braking systems as contemplated herein.
Figure 1B:
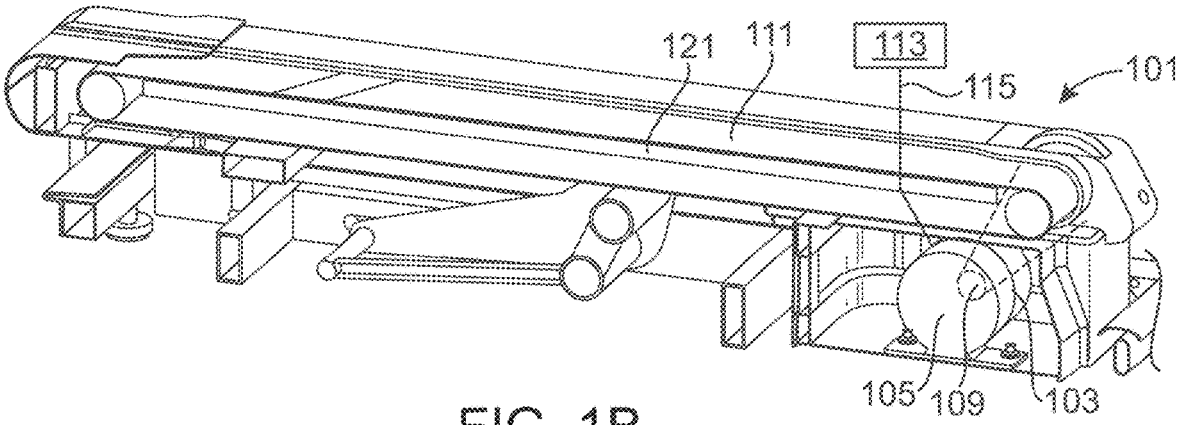
Figure 1C:
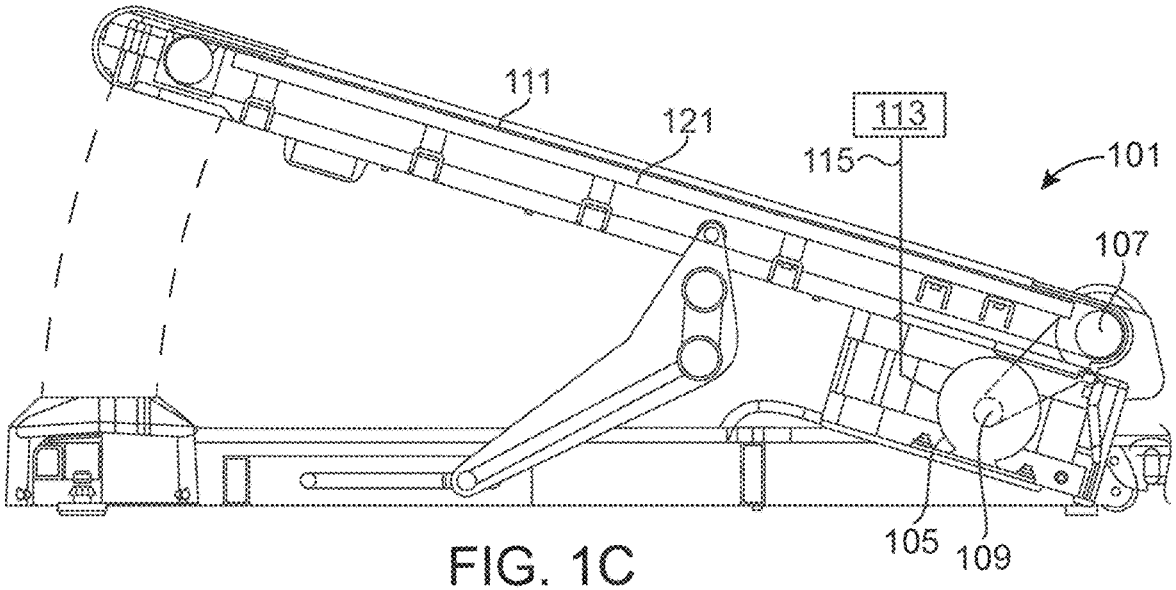
Figure 2A:
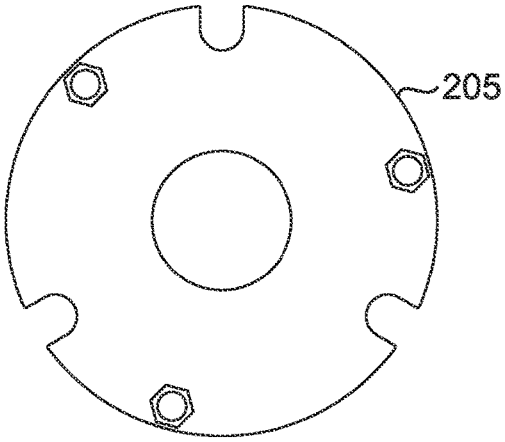
FIG. 2 depicts an embodiment of a mechanical brake according to the present disclosure.
Figure 2B:
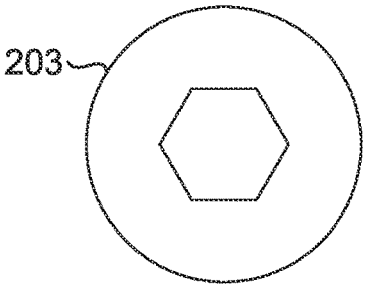
Figure 2C:
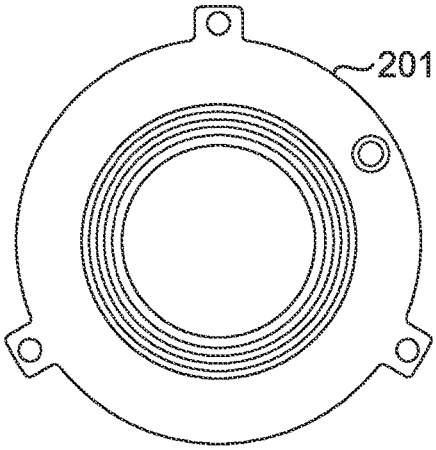
Figure 2D:
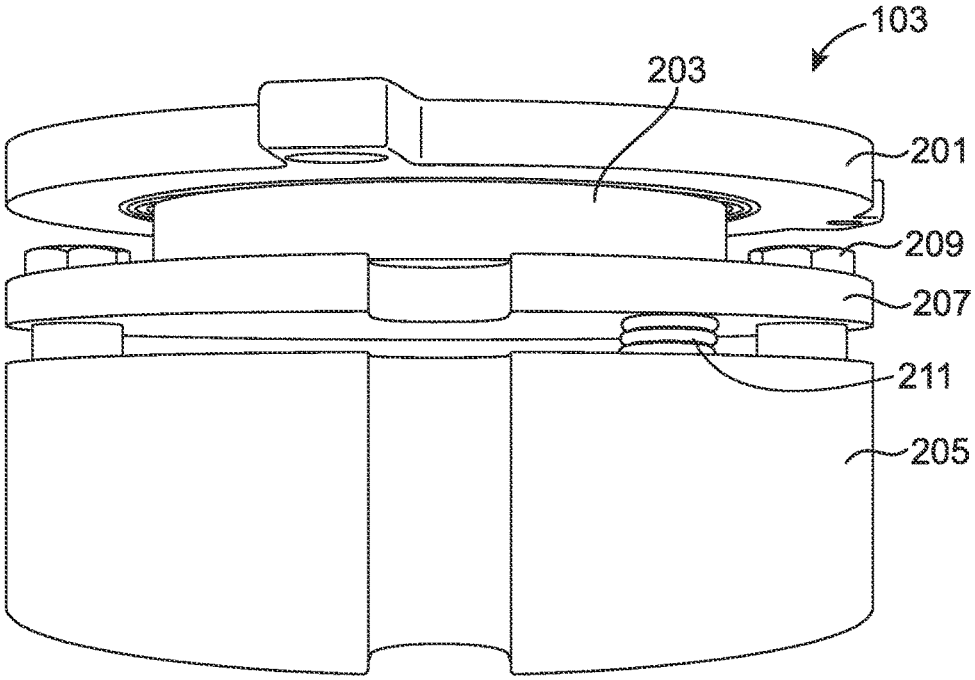

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Described herein, among other things, is a mechanical braking system (103) for a high-incline treadmill (101) utilizing a mechanical brake (103) which may be used on its own or in combination with a traditional motor brake. For purposes of this disclosure, the term "high-incline treadmill" means any treadmill where the running deck or belt is capable of adjusting to a position at least 15% from horizontal. It may also mean a treadmill wherein such adjusting is greater than 18%, 20%, 25%, 30% or 40% from horizontal and specifically includes all treadmills described or contemplated in U.S. Utility Pat. No. 9,764,184, issued Sep. 19, 2017, and in pending U.S. Utility Pat. No. 15/860,164, filed Jan. 2, 2018. The entire disclosures of both of which documents are incorporated herein by reference in their entirety.

In a conventional treadmill (101), the treadmill (101) comprises a running deck (121) surrounded by a continuous belt (111). The belt (111) is driven by one or more belt rollers (107) attached to a belt motor (105). The belt motor (105) is controlled and operated via a main circuit board (117) or computer system (117), which is connected to a user interface. The user interface may be as simple as dials or buttons, or may be more complex, including touch-activated screens and other computer-like interface features. When a user pushes buttons on the interface or the screen, electrical signals are sent to the motor (105) by the main circuit board (117), causing the motor (105) to turn the belt (111) at various running paces. Additionally, an incline motor, attached to an incline system, causes the incline angle of the deck to elevate or lower in response to user input via the interface. A high-incline treadmill (101) is generally of similar mechanical construction to a conventional treadmill. However, the deck (121) and belt (111) are capable of being rotated to an angle above those of a conventional treadmill. This often means that motor components and the structural supports may be positioned differently to allow for such motion.

Figure 3:
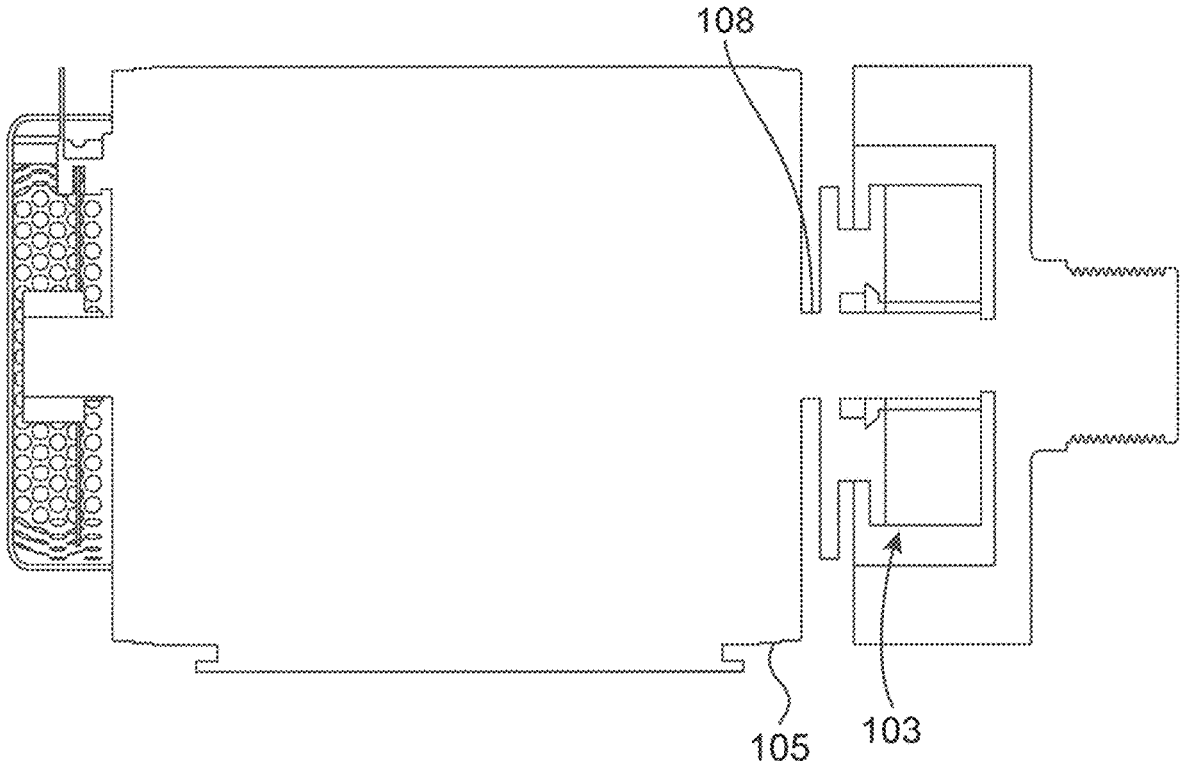
FIG. 3 depicts sectional view of an embodiment of the mechanical brake of FIG. 2 attached to a treadmill motor.

The mechanical brake (103) is generally mountable on a treadmill (101) at a position disposed between or around the belt motor (105) and the flywheel (109). In the depicted embodiment, the distance between the motor (105) and the flywheel (109) is larger than in prior designs to facilitate positioning of the brake (103). Upon engagement of the brake (103), the typical operation will result in the brake (103) engaging either the flywheel (109), the motor (105), or the axle between them in a way that effectively locks the axle, and thus the belt (111) in a fixed position. This may be through a variety of mechanisms, but may be through having an extremely high frictional engagement between the brake (103) and the flywheel (109) or by having a particularly high frictional engagement between the brake (103) and rotational components of the motor (105). In the depicted embodiment, the motor (105) will have attached thereto a brake mount (201) with which a brake pad (203) will engage to halt the rotor (108) in the motor. FIG. 3 shows an embodiment of a mechanical brake (103) mounted to the electric motor (105) of a treadmill (101).

As would be understand by one of ordinary skill in the art, a mechanical brake (103), such as that depicted in FIG. 2 may be used to carry out this activation. The brake depicted in FIG. 2 is of the type commonly called an electrically-released spring-set brake. While this general design is preferred for simplicity, pneumatic or hydraulic-set brakes may also be used in alternative embodiments. The brake (103) as depicted in FIG. 2 primarily comprises a brake mount (201), a brake pad (203), an armature (207), and a brake coil (205). The brake mount (201) is a structure sized and shaped to mount the mechanical brake (103) to the treadmill motor (105) (or another motor, if used with a device other than a treadmill). Attachment of the brake mount (201) to the motor (105) is typically done using hardware, such as bolts, but other means for such mounting will be familiar to one of ordinary skill in the art.

Generally, the brake mount (201) will be rigidly mounted to a non-moving component of the motor such as the stator and will allow for rotational components (the rotor 108)) of the motor (105) to turn through it. In an embodiment the brake mount (201) will mount to the stator coil or housing of the motor (105) and allow access to at least a portion of the rotor coil of the motor (105). In an alternative embodiment, the brake mount (201) will be mounted to an alternative static component.

The brake pad (203) is generally a structure known to be used in braking systems. The brake pad (203) causes the braking action by the brake pad (203) which is attached to the rotor (108) being pressed against a braking surface to be stopped. In the embodiment of FIG. 2, the brake pad (203) will be pushed toward the brake mount (201) by the armature (207) sandwiching the brake pad (203) between the brake mount (201) and the armature (207). The brake pad (203) will typically have a surface made of a material having an extremely high coefficient of friction so that contact of the brake pad (203) to the brake mount (201) and armature (207) will result in dramatic loss of energy from the rotor (108) which is engaged in the center of the brake pad (203) in a non-relative-rotational fashion (that is, the rotor (108) and the brake pad (203) rotate together). The kinetic energy of the rotor (108) is converted by brake pad (203) to heat. This will quickly slow or stop the rotor (108) of the motor (105). In the embodiment of FIG. 2, the brake pad (203) is a disc designed to connect to the rotor (108).

To alternatively engage and disengage the brake pad (203) there is an armature (207) which is attached in a constrained relationship to the brake coil (205). Specifically, the armature (207) will be allowed a constrained movement toward and away from the brake coil (205). In the depicted embodiment of FIG. 2, the movement is constrained by the presence of bolts (209) which provide that the armature (207) can only move generally linearly toward and away from the brake coil (205) and the distance of that movement is constrained by the brake coil (205) itself on one side, and the bolt (209) head on the other.

In order to provide for braking, the armature (207) will be biased via a biasing mechanism, which are springs (211) in the brake (103) of FIG. 2, away from the brake coil (205) and at the extreme distance of throw toward the brake mount (201). This will cause the brake pad (203) to be sandwiched between the brake mount (201) and the armature (207) to frictionally resist the movement of the brake pad (203) and thus rotation of the rotor (108) in the motor (105). In order to allow for free motor (105) movement, power is provided to the brake coil (205) which will be energized and act as an electromagnet pulling the armature (207) toward the brake coil (205) against the biasing of the springs (211). This will release the brake pad (203) from the sandwiching arrangement and allow it to turn.

As should be apparent from the above, the mechanical brake (103) is in "braking" position when unpowered. That is, the flow of electrical energy through the mechanical brake (103) causes the brake coil (205) to withdraw the armature (207) from the brake pad (203) thus permitting rotary motion of the motor (105). When power is disengaged, the lack of electricity through the brake coil (205) ceases the magnetic force being generated in the brake coil (205) and causes the armature (207) to move toward the brake pad (203) engaging the brake.

For use in a treadmill (101), the arrangement of powered and unpowered operation is particularly important. If the power is cut for any reason, the mechanical brake of FIG. 2 will immediately respond by the springs (211) pushing the armature (207) toward the brake pad (203), causing the brake pad (203) to be sandwiched slowing or stopping rotor (108) rotation. Further, the armature (207) cannot be withdrawn until power is restored. This prevents the treadmill from freewheeling in the event of a loss of power, improving user safety as the brake pad (203) is engaged unless it is actively unengaged.

In a treadmill (101), the primary concern for safety is typically a fall of the user who is running or walking on the treadmill (101). Should such an event occur, having the belt (111) and other moving components very quickly come to a halt eliminates much of the risk of these moving components presenting a pinch hazard and can dramatically reduce danger from the machine. Treadmills (101) have traditionally utilized a safety key which, when pulled, disconnects all power to all components of the treadmill (101). The safety key is designed to be pulled and disconnect power by a simple circuit breaker when a user has moved sufficiently away from the controller (113) panel to indicate the start of a fall. Thus, the belt (111) and other moving components are designed to have stopped prior to the fall actually completing and the user falling on the belt (111) or other motorized components. The safety key has now become ubiquitous, and is actually required on some treadmills (101) due to regulations.

As discussed above, the problem with traditional motor braking in a treadmill (101) when the safety key is pulled is that while the power disconnection is effective at stopping the belt (111) motion on a flat surface, it is not effective at maintaining the belt (111) in a stopped position after the power is disconnected, as the belt (111) can freewheel once the magnetic fields in the motor (105) have dissipated. Further, the induced field in the motor (105) may not be sufficient to stop the belt at a high incline, particularly at high speed.

The depicted mechanical brake (103) serves to not only assist in rapidly stopping the motor (105), but remains engaged unless and until power is restored. Thus, the brake (103) serves to keep the motor (105), and thus the belt (111) and other components, from freewheeling or otherwise moving even after dissipation of the induced fields. Thus, the mechanical brake (103) provides for additional safety in treadmill (101) operation, particularly in a high-incline treadmill (101).

It is recognized that the amount of brake force which is ideally applied may depend on the braking situation presented, as well as the angle of the belt (111), speed of the motor (105), and the mass of the user. For example, a much more rapid and stronger brake force is generally preferred when the safety key is pulled for a heavy user on a high incline at high speed. A lower braking force will generally be preferred when the treadmill (101) is manually stopped at a level incline and lower speed as would be typical of a user finishing their workout.

In order to provide for differing brake force to be applied in different circumstances, the brake (103) may be connected to various sensors or switches to assist in the brake application. In an embodiment, the depicted brake (103) may be connected to a tilt switch and sensor which causes the brake (103) to activate only if the incline of the treadmill (101) is above a certain predefined angle. By way of example, and not limitation, the brake (103) may activate only if the incline is detected to be 15% or greater, 18% or greater, 20% or greater, 25% or greater, 30% or greater, or 35% or greater. The specific incline at which the tilt switch feature will actuate will depend upon the particular design of a specific high-incline treadmill (101). Some designs, for example, may have sufficient friction of the belt (111) to slow the user without the assistance of a brake (103) at lower inclines than others. This may be desirable as the force of the mechanical brake engaging can be sudden and may cause a user to pitch forward if they are not expecting it. A similar switch and/or sensor may be used to trigger the mechanical brake only at certain belt speeds.

As the mechanical brake (103) engages should the power be disconnected, in the event of a power outage, the sudden engagement of the brake (103) when it is not really needed to avoid freewheeling after a fall, could actually produce a dangerous situation where the sudden braking could cause a user to pitch forward into the control panel (117). As should be apparent, such risk can be reduced by only having the mechanical brake (103) be armed to engage when the benefit outweighs any potential risk. This can be carried out by having the control panel (117) include circuitry to determine if a secondary power system should be supplied to the mechanical brake (103) or other sensors or systems should be engaged to control mechanical brake (103) operation.

In a still further embodiment, the brake (103) may actually be built to engage as a secondary brake mechanism. For example, the sudden reversing of magnetic field in the motor (105) may act to initially slow and stop the motor, then the mechanical brake (103) engages once these have begun to dissipate. This can occur within fractions of a second of the power disconnect and may be carried out, for example, by including capacitor or other power storage systems which cut power to the brake coil (205) at a time later than to the motor (105) when the safety key is disconnected. These types of multi-tier or stepped control mechanisms can also be used to engage the mechanical brake (103) once the motor (105) has effectively stopped to hold the motor (105) in the stopped position in any arrangement.

In the depicted embodiment, the braking system (103) further comprises a controller (113) in electrical communication (115) with the brake. The controller (113) comprises electrical components and circuitry configured to operate the brake (103). The controller (113) is also in electrical communication (115) with a primary circuit board (117) of the high-incline treadmill (101). This circuit board (117) operates the incline system of the treadmill (101), and thus has access to the current incline setting of the treadmill (101). This information may then be relayed to the brake controller (113), which will then control the brake (103). By way of example, and not limitation, if the main circuit board (117) determines that the incline is at or above the tilt switch threshold, and a stopping event is detected, then the main circuit board (117) will send a signal to the brake controller (113) indicating that the brake (103) should be operated. The controller (113) will then cause the brake (103) to actuate at a speed to appropriately slow the treadmill (101).

In the depicted embodiment, the brake (103) may be actuated upon the occurrence of any number of braking events. These may include, without limitation: the safety key is pulled; a pre-programmed workout routine has been completed or paused; the stop button has been pushed; or the machine loses power. The specific actuation of the mechanical brake (103) may also be different in the different scenarios both in the timing of the actuation of the brake (103), the specific brake force provided, and the speed at which the force is provided. Generally, the mechanical brake (105) will be designed to operate in a "brake safe" arrangement where any situation which results in stoppage of the treadmill belt (111) will engage the mechanical brake (105) either immediately or after traditional braking systems in some fashion.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A method for braking moving components of an exercise machine, the method comprising:

providing a high-incline treadmill including:

a running deck having a belt roller disposed at one end thereof and a continuous belt disposed around said running deck and belt roller;

an electric belt motor operatively coupled to said belt roller via a motor axle;

a flywheel disposed on said motor axle; and a mechanical brake including;

a brake mount;

a brake coil;

an armature positioned between said brake mount and said brake coil, said armature being constrained to move linearly toward and away from said brake coil and said brake mount;

springs biasing said armature away from said brake coil and toward said brake mount; and a brake pad positioned between said armature and said brake mount and attached to a rotor of said electric belt motor so as to rotate with said rotor;

supplying said electric belt motor and said brake coil with electricity, said electricity causing said rotor in said electric belt motor to rotate said belt roller to move said continuous belt around said running deck and said brake coil to pull said armature toward said brake coil against said biasing of said springs; and removing said electricity supply from said electric belt motor and said brake coil, said removal of said electricity causing said springs to bias said armature toward said brake mount sandwiching said brake pad between said armature and said brake mount and stopping and holding stopped said rotation of said rotor, thereby stopping the continuous belt.

* * * * *